United States Patent [19]

Overbeek et al.

[11] Patent Number: 4,891,060

[45] Date of Patent: Jan. 2, 1990

[54] PROCESS FOR THE RECOVERY OF GOLD USING PLASMA

[75] Inventors: Gerhardus Overbeek, Horison, South Africa; John K. Williams, Stanford in the Vale, United Kingdom; Charles P. Heanley, Little Coxwell, United Kingdom

[73] Assignees: Tetronics Research and Development Company Ltd., Oxfordshire, United Kingdom; Anglovaal Ltd., Johannesburg, South Africa

[21] Appl. No.: 234,686

[22] Filed: Aug. 22, 1988

[30] Foreign Application Priority Data

Aug. 27, 1987 [GB] United Kingdom ..... 8720279

[51] Int. Cl.[4] ..... C22B 11/00

[52] U.S. Cl. ..... 75/10.19; 75/83

[58] Field of Search ..... 75/10.19, 83; 373/22

[56] References Cited

U.S. PATENT DOCUMENTS 4,427,442 1/1984 Day ..... 75/10.19

4,448,604 5/1984 Day et al. ..... 75/83

*Primary Examiner*—Melvyn J. Andrews

*Attorney, Agent, or Firm*—Beveridge, DeGrandi & Weilacher

[57] ABSTRACT

A process for the recovery of gold from a refractory or non-refractory gold containing concentrate which contains sulphide minerals, which process comprises the steps of:

(i) heating the gold containing concentrate to a temperature of above 1150° C. in order to thermally decompose the sulphide minerals contained therein, and (ii) subjecting the thermal decomposition product obtained from step (i) to reaction with oxygen in a plasma arc furnace maintained at a temperature of above 1150° C.

8 Claims, No Drawings

PROCESS FOR THE RECOVERY OF GOLD USING PLASMA

The present invention relates to a process for the recovery of gold and in particular to a method for the recovery of gold from a refractory or non-refractory ore.

Gold is found as the native metal widely distributed in minute traces in various minerals, such as certain quartz ores and certain alluvial gravels. Gold bearing ores are usually treated by the cyanide process in which the ore is subjected to extraction with sodium cyanide. The cyanide solution then is contacted with a metal such as zinc to cause it to precipitate from solution.

Certain gold bearing ores which contain an appreciable amount of sulphide minerals are not generally amenable to the conventional cyanidation techniques for the extraction of gold. Such ores are generally termed "refractory" ores.

The method generally employed to extract gold from refractory ores consists of the roasting of sulphide concentrates obtained from crushed ores by flotation or other means of concentration. The roasting is followed by cyanidation. It is generally believed that roasting either liberates the gold from the sulphide minerals or at least exposes the gold to cyanide solutions. In this way, fairly satisfactory results may be obtained from some refractory ores.

For various reasons however, abnormally high amounts of gold are sometimes present after the cyanidation of the roasted products, and in the case of some refractory ores little or no gold is extracted in the manner described above and no economic processes to extract the gold exist.

The reasons for the refractory nature of a particular ore are many and varied. The following lists some of the causes which may contribute towards the refractory nature of ores.

The gold grains may be so fine that they may not be exposed by grinding. The gold may also occur in solid solution in the sulphides. The gold may be associated with minerals that form insoluble alloys with gold during roasting. Of these, antimony and lead bearing minerals, chalcopyrite and pyrrhotite, are considered to be most detrimental.

The gold containing ores may contain carbonaceous materials which could lead to the precipitation of gold from solution, or the gold containing ores may contain materials that interfere with the cyanidation process.

Furthermore, the gold may be locked-up in hematite during roasting, or the gold may be present in the form of gold alloys which are insoluble in cyanide.

An analysis of a typical refractory gold concentrate is given in the following Table I:

TABLE 1

| | | |
|---|---|---|
| Gold | Au | 230 $gt^{-1}$ (0.023%) |
| Iron | Fe | 27.7% |
| Sulphur | S | 29.8% |
| Arsenic | As | 7.1% |
| Antimony | Sb | 0.05% |
| Cobalt | Co | 0.04% |
| Zinc | Zn | 0.09% |
| Nickel | Ni | 0.30% |
| Lead | Pb | 0.02% |
| Copper | Cu | 0.11% |
| Manganese | Mn | 0.01% |
| Carbon | C | 0.78% |
| Silica | $SiO_2$ | 29.5% |

TABLE 1-continued

| | | |
|---|---|---|
| Alumina | $Al_2O_3$ | 2.36% |
| Sodium | as $Na_2O$ | 0.02% |
| Potassium | as $K_2O$ | 0.05% |
| Calcium | as CaO | 0.84% |
| Magnesium | as MgO | 0.76% |
| Chromium | as $Cr_2O_3$ | 0.07% |

Some of the sulphide minerals present in this ore are pyrite ($FeS_2$), arseno-pyrite (FeAsS), chalcopyrite ($CuFeS_2$), galena (PbS), sphalerite (ZnS) and stibnite ($Sb_2S_3$).

We have now developed a process for the economic recovery of gold from a refractory or non-refractory gold containing concentrates.

Accordingly, the present invention provides a process for the recovery of gold from a refractory or non-refractory gold containing concentrate which contains sulphide minerals which process comprises the steps of:

(i) heating the gold containing concentrate to a temperature of above 1150° C. in order to thermally decompose the sulphide minerals contained therein, and (ii) subjecting the thermal decomposition product obtained from step (i) to reaction with oxygen in a plasma arc furnace maintained at a temperature of above 1150° C.

In the treatment of refactory ores, the first stage of the process of the invention comprises thermally decomposing (pyrolysing) the sulphide minerals, such as pyrite and arsenopyrite, in order to recover sulphur. The reactions which are involved are as follows:

$$\underset{\text{Pyrite}}{FeS_2} \xrightarrow{\text{heat}} \underset{\text{Pyrrhotite}}{FeS\ (1)} + \underset{\text{Sulphur}}{\tfrac{1}{2}\ S_2(g)}$$

$$\underset{\text{Arsenopyrite}}{FeAsS} \xrightarrow{\text{heat}} FeS\ (1) + \tfrac{1}{2}\ As_2(g)$$

$$As_2(g) + 3/2\ S_2(g) \longrightarrow \underset{\text{Arsenic sulphide}}{As_2S_3(g)}$$

The thermal decomposition of the sulphide minerals may be effected in any furnace which can operate at the desired temperature of above 1150° C., for example an electric arc furnace or a plasma arc furnace A typical analysis of the products produced on pyrolysis of a refractory gold containing ore is given below in Table II:

TABLE II

| Test Fraction | | Feed | Pyrolysis Residue | Volatiles |
|---|---|---|---|---|
| Iron | Fe | 27.7% | 37.1% | tr. |
| Sulphur | S | 29.8% | 20.1% | 66.3% |
| Arsenic | As | 7.1% | 0.08% | 33.6% |
| Antimony | Sb | 0.05% | 0.01% | 0.21% |
| Cobalt | Co | 0.04% | 0.05% | — |
| Nickel | Ni | 0.30% | 0.37% | — |
| Copper | Cu | 0.11% | 0.15% | — |
| Mananese | Mn | 0.01% | 0.01% | — |
| Carbon | C | 0.78% | 1.01% | — |
| Silica | $SiO_2$ | 29.5% | 39.1% | — |
| Alumina | $Al_2O_3$ | 2.36% | 2.97% | — |
| Lime | CaO | 0.84% | 1.10% | — |
| Magnesia | MgO | 0.76% | 1.01% | — |
| Gold | Au | 230 ppm | 308 ppm | — |
| Mass % | | 100 | 74.7 | 19.6 |

The second step of the process of the invention comprises the reaction with oxygen of the pyrolysed product obtained from the first stage, optionally with silica addition, at temperatures above 1150° C., preferably at a temperature of above 1350° C., in a plasma arc furnace. The reaction with oxygen may be carried out by controlled air blowing of the product from step (i) of the process. This reaction produces a slag layer and a metal/metal sulphide layer. Because of the much higher solubility of gold in metal sulphides as compared to the metal silicates contained in the slag layer, the gold concentrates in the metal/metal sulphide layer i.e. the metal/metal sulphide layer acts as a collector. Furthermore, because of the low viscosity of the slag and the use of a plasma arc furnace in step (ii) of the process, prill entrapment is minimized.

A typical analysis of the products produced in the second stage of the process of the invention in the treatment of a refractory gold containing ore is are given in Table III below:

TABLE III

| Process Fraction | | Pyrolysed Feed | Slag Phase | Metal/Metal Sulphide Phase |
|---|---|---|---|---|
| Iron | Fe | 37.1% | 38.4% | 54.4% |
| Sulphur | S | 20.1% | 0.45% | 30.7% |
| Arsenic | As | 0.08% | 0.03% | 0.81% |
| Antimony | Sb | 0.10% | — | 1.76% |
| Cobalt | Co | 0.05% | — | 0.85% |
| Nickel | Ni | 0.37% | — | 6.50% |
| Copper | Cu | 0.15% | — | 2.74% |
| Manganese | Mn | 0.01% | 0.01% | — |
| Carbon | C | 1.01% | tr. | 3.50% |
| Silica | $SiO_2$ | 39.1% | 44.3% | — |
| Alumina | $Al_2O_3$ | 2.97% | 3.36% | — |
| Lime | CaO | 1.10% | 1.25% | — |
| Magnesia | MgO | 1.01% | 1.14% | — |
| Gold | Au | 308 ppm | 7.8 ppm | 5320 ppm |
| Mass % | | 100 | 88.3 | 5.67 |

The gold concentrate thus obtained represents less than 5% of the mass of the original refractory gold containing concentrate and contains about 98% of the available gold.

The process of the present invention may also be used for the recovery of gold from refractory or non-refractory calcines. In this case a quantity of a sulphur bearing mineral, such as pyrite, is added to provide a matte phase for gold collection.

In addition it has been found that in the presence of arsenic bearing materials, a speiss (arsenide) phase is formed in which the gold concentrates in preference to concentrating in the matte phase formed. It may therefore be advantageous to add an arsenic bearing mineral to the calcine which is to be treated. In operating the process of the invention for the recovery of gold from calcines, step (ii) is preferably operated by blowing air to a relatively small amount of matte, followed by tapping of the speiss, a small amount of matte being maintained to act as a buffer in order to prevent the speiss from oxidising.

The plasma arc furnace used in the second stage of the process of the present invention and optionally in the first stage is preferably a furnace in which a precessing plasma column is generated.

The generation of a precessing plasma column is known in the art and is described, for example, in British Patent Specification Nos. 1390351, 1390353 and 1511832.

In the generation of a precessing plasma arc column the upper electrode moves about a substantially vertical axis in a predetermined path above the stationary electrode, thereby generating the precessing plasma arc column. The plasma arc column may move along any predetermined path, such as a circle, ellipse, spiral, square, etc.

Whilst almost all gases can be ionized to form a plasma, in the present invention non-oxidizing gases are used such as the inert gases, He, Ne, Ar, Kr, Xe or Rn, as well as $H_2$, CO, $N_2$ and mixtures of these gases. Argon or nitrogen are the most preferred gases for use.

The use of a plasma arc furnace in the second stage of the process of the invention is essential in order to provide the high temperatures required for reaction and in order to enable accurate control of the temperature of operation to be achieved.

Conventional plasma arc furnaces which have a refractory crucible constructed to receive the charge of materials and contained within an insulated enclosure may be used in the present invention.

In carrying out the process of the invention, the temperature in step (i) may be, for example, in the range of from 1150° to 1450° C., preferably 1200° to 1450° C. whilst the temperature in the step (ii) may be in the range of from 1150° to 1600° C., preferably 1350° to 1600° C.

Generally, the materials fed to the furnace i.e. the refractory concentrate or the calcine in step (i) and the thermal decomposition product optionally together with silica, will be in finely divided particulate form.

Preferably the metal/metal sulphide layer which contains the gold is separated from the slag layer and thereafter is subjected to treatment, by conventional methods, in order to recover gold therefrom.

The present invention will be further described with reference to the following Example.

EXAMPLE

A calcined gold bearing ore, containing from 250 to 350 ppm of gold, was subjected to cyanidation. The residue from this cyanidation step, which contained 25 ppm gold, was dried and blended with a flotation concentrate, lime and carbon and fed to a plasma arc furnace. The flotation concentrate contained 212 ppm of gold. The composition of the feed blend was as detailed below:

Calcine: 10.0 kg
Flotation Concentrate: 1.0 kg
Lime: 1.0 kg
Carbon: 0.5 kg

A plasma arc furnace was used to carry out both the pyrolysis and oxygen reaction steps.

On heating the above mixture to 1365° C., three molten phases were produced, having the following mass and gold distributions.

| Phase | Mass (grams) | Gold Content (ppm) |
|---|---|---|
| Slag | 8568 | 1.0 |
| Matte | 644 | 87.2 |
| Speiss | 371 | 1124.7 |

The balance of the feed mass formed a gaseous phase which was ducted out through the furnace exhaust port. A small amount (less than 1%) of fines trapped in the off gas stream were collected by means of suitable dust collection equipment and subsequently returned to the furnace. The products were tapped out of the furnace. The slag was discarded while the matte and speiss were processed further in order to recover the gold values contained therein.

We claim:

1. A process for the recovery of gold from a refractory or non-refractory gold containing concentrate which contains sulphide minerals and which contains arsenic and/or antimony, or to which an arsenic bearing material is added, which process consists essentially of:

(i) heating the gold containing concentrate to a temperature of above 1150° C. in order thermally to decompose the sulphide minerals contained therein and to form a slag phase, a metal/metal sulphide (matte) phase and a speiss phase, (ii) separating the slag phase from the matte and speiss phases, (iii) reacting the matte and speiss phases obtained from step (ii) with oxygen using a plasma arc column generated in a plasma arc furnace to maintain a temperature of above 1150° C., and (iv) processing the matte and speiss phases after reaction in step (iii) in order to recover gold therefrom.

2. Process according to claim 1 wherein the heating in step (i) is carried out in a plasma arc furnace.

3. Process according to claim 1 wherein the heating in step (i) is carried out at a temperature in the range of from 1150° to 1450° C.

4. Process according to claim 1 wherein the matte and speiss phases are subjected in step (iii) to air blowing.

5. Process according to claim 1 wherein the reaction in step (iii) is carried out at a temperature in the range of from 1350° to 1600° C.

6. Process according to claim 1 wherein the plasma arc column used in step (iii) is a precessing plasma arc column.

7. Process according to claim 6 wherein the inert gas used in the plasma arc furnace is selected from the group consisting of argon and nitrogen.

8. Process according to claim 1 wherein silica is added to the matte and speiss phases treated in step (iii) of the process.

* * * * *